US008435710B2

(12) United States Patent
Kunii et al.

(10) Patent No.: US 8,435,710 B2
(45) Date of Patent: May 7, 2013

(54) TONER FOR ELECTROSTATIC IMAGE DEVELOPMENT

(75) Inventors: Satoshi Kunii, Wakayama (JP); Masahito Yamazaki, Wakayama (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 13/309,921

(22) Filed: Dec. 2, 2011

(65) Prior Publication Data

US 2012/0156603 A1 Jun. 21, 2012

(30) Foreign Application Priority Data

Dec. 20, 2010 (JP) ..... 2010-283519

(51) Int. Cl.
*G03G 9/00* (2006.01)

(52) U.S. Cl.
USPC ..... 430/108.6; 430/108.1; 430/108.7

(58) Field of Classification Search ..... 430/108.1, 430/108.6, 108.7
See application file for complete search history.

(56) References Cited

U.S. PATENT DOCUMENTS 5,695,902 A 12/1997 Mikuriya et al.
2009/0239171 A1* 9/2009 Anno et al. ..... 430/109.4
2009/0280426 A1 11/2009 Kunii et al.
2010/0009282 A1* 1/2010 Katoh et al. ..... 430/124.1
2010/0330493 A1 12/2010 Kaneeda et al.

FOREIGN PATENT DOCUMENTS

| | | |
|---|---|---|
| JP | 8-292598 | 11/1996 |
| JP | 9-204065 | 8/1997 |
| JP | 2002-182424 | 6/2002 |
| JP | 2004-177747 | 6/2004 |
| JP | 2009-301015 | 12/2009 |
| JP | 2010-20024 | 1/2010 |
| WO | WO 2009/084184 A1 | 7/2009 |

OTHER PUBLICATIONS

U.S. Appl. No. 13/309,731, filed Dec. 2, 2011, Yamazaki, et al.

* cited by examiner

*Primary Examiner* — Stewart Fraser
(74) *Attorney, Agent, or Firm* — Oblon, Spivak, McClelland, Maier & Neustadt, L.L.P.

(57) ABSTRACT

A toner for electrostatic image development containing an external additive comprising composite oxide particles made of titania and silica (external additive A), and hydrophobic silica particles (external additive B), wherein the external additive A has a core-shell structure in which a core portion is made of titania and a shell portion is made of silica, wherein the titania is contained in the external additive A in an amount of from 75 to 95% by weight, and wherein the external additive B has a carbon content of from 2.8 to 6.0% by weight. The toner for electrostatic image development of the present invention is suitably used in, for example, the development or the like of latent image formed in electrophotography, an electrostatic recording method, an electrostatic printing method, or the like.

10 Claims, 3 Drawing Sheets

TONER FOR ELECTROSTATIC IMAGE DEVELOPMENT

FIELD OF THE INVENTION

The present invention relates to a toner for electrostatic image development usable in developing latent images formed in, for example, electrophotography, an electrostatic recording method, an electrostatic printing method, or the like, a two-component developer, and a method of forming fixed images using the toner and the two-component developer.

BACKGROUND OF THE INVENTION

With the demands in speeding-up, miniaturization or the like of copy machines and laser printers in the recent years, various external additives are used for the purpose of improving fluidity or triboelectric chargeability of a toner.

For example, JP-A-2010-20024 (US-A-2010-009282) discloses that a toner containing a composite oxide having a core-shell structure in which a core portion contains titanium oxide and a shell portion contains silicon oxide, wherein titanium oxide is contained in an amount of from 80 to 95% by weight serves to suppress background fogging or soiling of a charging roller.

JP-A-2002-182424 discloses that a toner containing fine metal oxide particles having a core-shell structure in which a core layer is made of a metal oxide selected from titanium dioxide, aluminum oxide, and zinc oxide, and a shell layer is made of silica, the fine metal oxide particles having an average particle size of from 10 to 30 nm and a degree of sphericity of from 1 to 1.3 is free from background fogging, faded print, and filming and the like, and has excellent durability, thereby exhibiting a high optical density.

JP-A-2004-177747 discloses that a toner containing silica-coated metal oxide particles having a core-shell structure in which a core layer is made of a metal oxide selected from titanium dioxide, aluminum oxide, and zinc oxide, and a shell layer is made of silica, and fine silica particles having a volume-average particle size of from 5 to 20 nm, has excellent cleanability and gives excellent image quality.

WO 2009/084184 (US-A-2010-330493)discloses a toner containing surface-modified, fine composite oxide particles comprising silica-titania composite oxide particles produced by a vapor phase method subjected to a surface treatment has a small change in triboelectric charges with the passage of time.

JP-A-Hei-8-292598 discloses that a toner containing particles comprising fine inorganic particles of which primary particles have an average particle size of from 30 to 100 nm, hydrophobically treated with a dimethyl silicone oil, the particles having a carbon content ascribed to the dimethyl silicone oil in the particles of from 3.1 to 6.0% by weight has excellent developability, transferability and stability with the passage of time, and the publication describes that there is a correlation between the carbon content and phenomena so-called "characters containing non-printed spots."

JP-A-Hei-9-204065(U.S. Pat. No. 5,695,902) discloses that a toner containing an inorganic fine powder (A) treated with at least a silicone oil, and an inorganic fine powder (B) containing a composite metal oxide one of which constituent is at least Si, and having a weight-average particle size is from 0.3 to 5 μm has excellent developing stability, high transferability and sleeve coatability under various environmental conditions, and gives high image quality even upon durability printing for numerous sheets, and the publication discloses that the inorganic fine powder (A) treated with the silicone oil is externally added to toner particles, whereby phenomena so-called a "hollow character" can be prevented over a long period of time.

SUMMARY OF THE INVENTION

The present invention relates to:

[1] a toner for electrostatic image development containing an external additive containing composite oxide particles made of titania and silica (external additive A), and hydrophobic silica particles (external additive B), wherein the external additive A has a core-shell structure in which a core portion is made of titania and a shell portion is made of silica, wherein the titania is contained in the external additive A in an amount of from 75 to 95% by weight, and wherein the external additive B has a carbon content of from 2.8 to 6.0% by weight;

[2] a two-component developer containing a toner for electrostatic image development as defined in the above [1] and a carrier; and

[3] a method for forming fixed images including the step of applying a toner for electrostatic image development as defined in the above [1], or a two-component developer as defined in the above [2] to an apparatus for forming fixed images according to a hybrid development method.

DETAILED DESCRIPTION OF THE INVENTION

Figure 1:
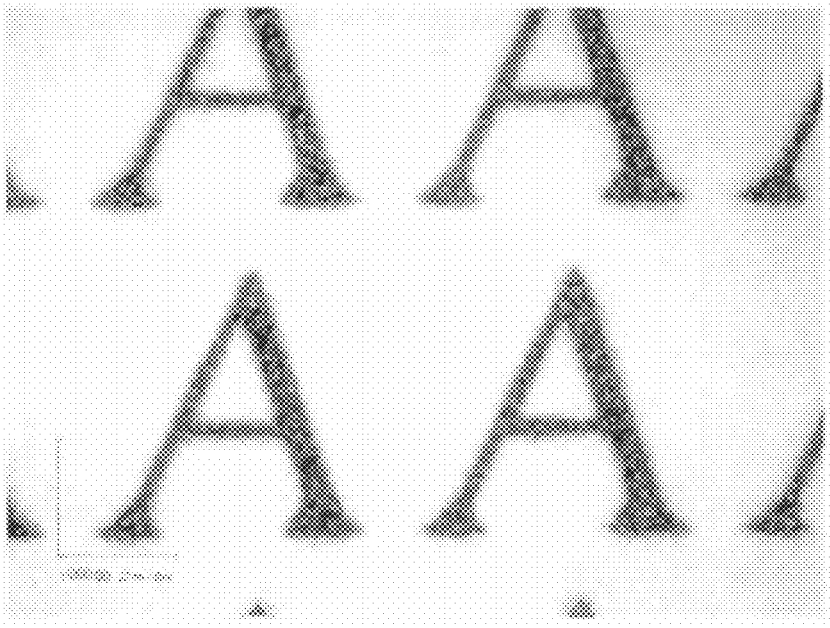
FIG. 1 is an optical photomicrograph (magnification: 50×) showing characters containing non-printed spots in Example 1.

In copy machines and laser printers which are speeded up and miniaturized, it is insufficient in a conventional toner for suppressing the generation of non-printed spots in characters, when subjected to continuous printing for a long period of time.

The present invention relates to a toner capable of suppressing the generation of non-printed spots in characters even when subjected to continuous printing for a long period of time, a two-component developer using the toner, and a method of forming fixed images using the toner and the two-component developer.

The toner and the two-component developer containing the toner of the present invention exhibits an effect of suppressing the generation of non-printed spots in characters even when subjected to continuous printing for a long period of time.

These and other advantages of the present invention will be apparent from the following description.

A feature of the toner of the present invention is a toner containing an external additive containing composite oxide particles made of titania and silica (external additive A) and hydrophobic silica particles (external additive B), wherein the external additive A has a core-shell structure in which a core portion is made of titania and a shell portion is made of silica, wherein the titania is contained in the external additive A in an amount of from 75 to 95% by weight, and wherein the external additive B has a carbon content of from 2.8 to 6.0% by weight.

Although not wanting to be limited by theory, while the reasons why the toner exhibits the effects of suppressing the generation of non-printed spots in characters are not elucidated, they are considered to be as follows.

An external additive A is composite oxide particles made of titania and silica, and the particles have a core-shell structure in which the silica is a shell layer, so that titania is hardly present on the surface of the particles. For this reason, triboelectric charges of a toner can be appropriately controlled by controlling a volume resistivity of an external additive A to fall between a volume resistance of silica and a volume resistance of titania. In addition, since titania is hardly present on the surface of the particles, the surface state of the particles of the external additive A is even, whereby the toner can have a sharp distribution of triboelectric charges. As a result, triboelectric charges can be stably maintained at an appropriate level even when subjected to continuous printing for a long period of time.

On the other hand, since an external additive B is a silica having a high carbon content, adhesive strength between the toner particles can be increased, as compared to a silica having a small carbon content.

Although not wanting to be limited by theory, it is deduced that the generation of non-printed spots in characters takes place in a case of strong electrostatic interactions between an image-transferable material and toner particles, in other words, large triboelectric charges of a toner, or in a case of weak adhesive strength between toner particles. By using the external additive A together with the external additive B, it is considered that the electrostatic interactions between the image-transferable material and toner particles and the adhesive strength between the toner particles are stably and properly controlled even when a toner is subjected to continuous printing for a long period of time, thereby suppressing the generation of non-printed spots in characters.

The toner of the present invention contains toner matrix particles and an external additive A and an external additive B. In other words, the toner comprises toner matrix particles, and an external additive A and an external additive B adhered thereto.

<External Additive A>

The external additive A is composite oxide particles made of titania and silica. The external additive A may contain a substance other than titania and silica within the range that would not impair the effects of the present invention.

The titania and the silica are contained in the external additive A in a total amount of preferably 95% by weight or more, more preferably 97% by weight or more, even more preferably 99% by weight or more, and even more preferably substantially 100% by weight. Here, in a case where the composite oxide particles are subjected to a hydrophobic treatment mentioned later, the total amount of the titania and the silica contained is an amount contained in the composite oxide particles before the hydrophobic treatment.

The external additive A has a shell-core structure in which a core portion is made of titania, and a shell portion is made of silica, from the viewpoint of controlling volume resistance of an external additive A to fall between those of silica and titania, thereby appropriately controlling triboelectric charges of a toner, from the viewpoint of making the distribution of triboelectric charges of a toner sharper, thereby improving triboelectric stability, from the viewpoint of facilitating a hydrophobic treatment of an external additive A, thereby increasing adhesive strength between a member such as an image-transferable material or a photoconductor and toner particles, and increasing adhesive strength between toner particles, and from the viewpoint of consequently suppressing the generation of non-printed spots in characters, thereby maintaining an appropriate optical density. The core portion may contain a substance other than the titania within the range that would not impair the effects of the present invention, and the shell portion may contain a substance other than the silica within the range that would not impair the effects of the present invention.

The titania is contained in the external additive A in an amount of 95% by weight or less, preferably 92% by weight or less, and more preferably 90% by weight or less, from the viewpoint of being able to evenly coat a core portion with a shell portion, thereby uniformly controlling triboelectric charges, and from the viewpoint of lowering an amount of the titania contained, thereby increasing a volume resistance of an external additive A, thereby controlling triboelectric charges to an appropriate level, and from the viewpoint of consequently suppressing the generation of non-printed spots in characters, thereby maintaining an appropriate optical density. In addition, the titania is contained in the external additive A in an amount of 75% by weight or more, preferably 78% by weight or more, and more preferably 80% by weight or more, from the viewpoint of increasing an amount of the titania contained, thereby lowering a volume resistance of an external additive A, thereby controlling triboelectric charges to an appropriate level, and suppressing the generation of non-printed spots in characters, thereby maintaining an appropriate optical density. From these viewpoints taken together, the titania is contained in the external additive A in an amount of from 75 to 95% by weight, preferably from 78 to 92% by weight, and more preferably from 80 to 90% by weight. Here, in a case where the composite oxide particles are subjected to a hydrophobic treatment described later, the amount of the titania contained is an amount contained in the composite oxide particles before the hydrophobic treatment.

The silica is contained in an amount of preferably 5% by weight or more, more preferably 8% by weight or more, and even more preferably 10% by weight or more, of the external additive A, from the viewpoint of being able to evenly coat a core portion with a shell portion, and consequently from the viewpoint of suppressing the photoconductor wear of the toner during durability printing, and maintaining an optical density. In addition, the silica is contained in an amount of preferably 25% by weight or less, more preferably 22% by weight or less, and even more preferably 20% by weight or less, of the external additive A, from the viewpoint of enabling the external additive A to construct a core-shell structure, thereby consequently suppressing the photoconductor wear of the toner during durability printing, and maintaining an optical density. From these viewpoints taken together, the silica is contained in an amount of preferably from 5 to 25% by weight, more preferably from 8 to 22% by weight, and even more preferably from 10 to 20% by weight, of the external additive A. Here, in a case where the composite oxide particles are subjected to a hydrophobic treatment described later, the amount of the silica contained is an amount contained in the composite oxide particles before the hydrophobic treatment.

The external additive A has an average primary particle size of preferably 10 nm or more, and more preferably 15 nm or more, from the viewpoint of preventing embedment of the external additive A into the toner, thereby consequently suppressing the generation of non-printed spots in characters, and maintaining an appropriate optical density. In addition, the external additive A has an average primary particle size of preferably 50 nm or less, and more preferably 40 nm or less, from the viewpoint of evenly coating the surface of a toner, thereby controlling triboelectric charges of a toner to a stable and appropriate value, thereby suppressing the generation of non-printed spots in characters, and maintaining an appropriate optical density. From these viewpoints taken together, the external additive A has an average primary particle size of preferably from 10 to 50 nm, and more preferably from 15 to 40 nm. The average primary particle size can be obtained by a method described in Examples set forth below.

In the external additive A, it is preferable that the surface of the particles is subjected to a hydrophobic treatment, from the viewpoint of reducing adhesive strength between a member such as an image-transferable material or a photoconductor and toner particles to improve transferability, thereby suppressing the generation of non-printed spots in characters, and maintaining an appropriate optical density.

Since the external additive A has a core-shell structure in which the silica is a shell layer, the external additive A can be subjected to a more even hydrophobic treatment as compared to that of composite oxide particles made of titania and silica having a non-core-shell structure in which titania exists on the surface, whereby consequently the generation of non-printed spots in characters can be suppressed, and an appropriate optical density can be maintained.

In a case where the external additive A is subjected to a hydrophobic treatment, carbon ascribed to a hydrophobic treatment agent would be contained in the external additive A. The hydrophobically treated external additive A has a carbon content of preferably 0.5% by weight or more, and more preferably 1.0% by weight or more, from the viewpoint of reducing adhesive strength between a member such as an image-transferable member or a photoconductor and toner particles, and improving transferability of a toner, thereby suppressing the generation of non-printed spots in characters, and maintaining an appropriate optical density. In addition, the hydrophobically treated external additive A has a carbon content of preferably 2.0% by weight or less, and more preferably 1.5% by weight or less, from the viewpoint of controlling triboelectric charges of a toner to an appropriate level, thereby suppressing the generation of non-printed spots in characters, and maintaining an appropriate optical density. From these viewpoints taken together, the hydrophobically treated external additive A has a carbon content of preferably from 0.5 to 2.0% by weight, and more preferably from 1.0 to 1.5% by weight. The carbon content of the external additive A can be adjusted by changing an amount of a hydrophobic treatment agent used in the hydrophobic treatment. In addition, the carbon content of the external additive A can be obtained by a method described in Examples set forth below.

The hydrophobically treating agent includes organochlorosilanes, such as dimethyldichlorosilane (DMDS); organoalkoxysilanes, such as octyltriethoxysilane (OTES) and methyltriethoxysilane; organodisilazanes, such as hexamethyldisilazane (HMDS); cyclic organopolysilazanes; linear organopolysiloxanes and the like.

Among them, the organodisilazanes are preferred, and hexamethyldisilazane is more preferred, from the viewpoint of appropriately controlling adhesive strength between a member such as an image-transferable material or a photoconductor and toner particles, and adhesive strength between toner particles.

The external additive A is contained in an amount of preferably 0.05 parts by weight or more, more preferably 0.1 parts by weight or more, even more preferably 0.2 parts by weight or more, and even more preferably 0.3 parts by weight or more, based on 100 parts by weight of the toner matrix particles, from the viewpoint of maintaining an appropriate optical density of a toner. In addition, the external additive A is contained in an amount of preferably 3 parts by weight or less, more preferably 1.5 parts by weight or less, even more preferably 0.7 parts by weight or less, and even more preferably 0.5 parts by weight or less, based on 100 parts by weight of the toner matrix particles, from the viewpoint of suppressing the generation of non-printed spots in characters of a toner. From these viewpoints taken together, the external additive A is contained in an amount of preferably from 0.05 to 3 parts by weight, more preferably from 0.1 to 1.5 parts by weight, even more preferably from 0.2 to 0.7 parts by weight, and even more preferably from 0.3 to 0.5 parts by weight, based on 100 parts by weight of the toner matrix particles.

The external additive A can be prepared in accordance with, for example, a method described in JP-A-2006-511638 or JP-A-Hei-11-193354, or the like.

For example, the external additive A is obtained by introducing silicon tetrachloride gas and titanium tetrachloride gas into a mixing chamber equipped with a combustion burner together with an inert gas, mixing hydrogen and the air to provide a mixed gas with a given ratio, combusting this mixed gas in a reaction chamber at 1000° to 3000° C. to form a composite oxide, cooling a reaction product, and collecting the product with a filter.

Alternatively, the external additive A can be also obtained by preparing a fine titanium oxide particle dispersion using a disperser in an alcohol solvent, thereafter sequentially adding an alkoxysilane compound, an alcohol, an aqueous ammonia, the above dispersion, and further water while mixing, carrying out hydrolysis of an alkoxide at 80° C., depositing a silica layer on the surface of fine titanium oxide particles, and thereafter filtering, washing, drying and pulverizing the product.

The hydrophobic treatment is carried out by, for example, spraying a liquid mixture previously prepared by diluting a necessary amount of a hydrophobic treatment agent in a solvent while stirring a raw composite oxide material in a mixing vessel at room temperature, raising the temperature inside the vessel while further continue stirring the raw composite oxide material, stirring for a given time period, and thereafter cooling the product.

Specific examples of the external additive A include STX801, STX501 (hereinabove, commercially available from Nippon Aerosol Co., Ltd.), and the like.

<External Additive B>

An external additive B used in the present invention is hydrophobically treated silica particles, from the viewpoint of appropriately increasing adhesive strength between the toner particles, and transferring the toner particles in the form of an aggregate, thereby suppressing the generation of non-printed spots in characters and maintaining an appropriate optical density.

The external additive B has a carbon content of 2.8% by weight or more, preferably 3.0% by weight or more, and more preferably 3.1% by weight or more, from the viewpoint of appropriately increasing adhesive strength between the toner particles, thereby providing the toner particles in the form of an aggregate, and transferring as an aggregate, whereby suppressing the generation of non-printed spots in characters and maintaining an appropriate optical density. In addition, the external additive B has a carbon content of 6.0% by weight or less, preferably 5.6% by weight or less, more preferably 5.0% by weight or less, and even more preferably 4.0% by weight or less, from the viewpoint of appropriately increasing adhesive strength between toner particles, controlling triboelectric charges to an appropriate level, suppressing the generation of non-printed spots in characters and maintaining an appropriate optical density. From these viewpoints taken together, the external additive B has a carbon content of from 2.8 to 6.0% by weight, preferably from 3.0 to 5.6% by weight, more preferably from 3.0 to 5.0% by weight, and even more preferably from 3.1 to 4.0% by weight. Here, the carbon content of the external additive B can be obtained by a method described in Examples set forth below.

The carbon content of the external additive B is derived from a hydrophobic treatment agent. The hydrophobic treatment agent is preferably an organopolysiloxane, among which dimethyl silicone oil is more preferred, from the viewpoint of increasing carbon content.

Dimethyl silicone oil has a viscoelasticity at 25° C. of preferably 50 cSt or more, from the viewpoint of suppressing volatility and flammability of dimethyl silicone oil in the hydrophobic treatment step, and dimethyl silicone oil has a viscoelasticity at 25° C. of preferably 10000 cSt or less, and more preferably 500 cSt or less, from the viewpoint of evenly depositing on the silica surface.

The external additive B has an average primary particle size of preferably 30 nm or more, more preferably 32 nm or more, and even more preferably 35 nm or more, from the viewpoint of thickening a silicone oil layer based on a unit surface area of silica, thereby increasing adhesive strength between toner particles. On the other hand, the external additive B has an average primary particle size of preferably 100 nm or less, more preferably 70 nm or less, and even more preferably 50 nm or less, from the viewpoint of preventing the external additive B from being detached from the toner matrix particles. From these viewpoints taken together, the external additive B has an average primary particle size of preferably from 30 to 100 nm, more preferably from 32 to 70 nm, and even more preferably from 35 to 50 nm. The average primary particle size can be obtained by a method described in Examples set forth below.

The external additive B is contained in an amount of preferably 0.05 parts by weight or more, more preferably 0.1 parts by weight or more, and even more preferably 0.3 parts by weight or more, based on 100 parts by weight of the toner matrix particles, from the viewpoint of suppressing the generation of non-printed spots in characters of a toner and maintaining an appropriate optical density. In addition, the external additive B is contained in an amount of preferably 3 parts by weight or less, more preferably 1.5 parts by weight or less, and even more preferably 0.7 parts by weight or less, based on 100 parts by weight of the toner matrix particles, from the viewpoint of suppressing the generation of non-printed spots in characters of a toner. From these viewpoints taken together, the external additive B is contained in an amount of preferably from 0.05 to 3 parts by weight, more preferably from 0.1 to 1.5 parts by weight, and even more preferably from 0.3 to 0.7 parts by weight, based on 100 parts by weight of the toner matrix particles.

The external additive B is obtained, for example, as follows. The silica particles are placed in a mixing vessel, and a solution previously prepared by diluting a necessary amount of a hydrophobic treatment agent in a solvent is sprayed thereto, while stirring at room temperature. After spraying, the temperature inside the vessel is raised while stirring the silica particles, and the contents are further stirred. Thereafter, the contents are cooled, to obtain an external additive B.

The external additive A and the external additive B are contained in a total amount of preferably 0.1 parts by weight or more, more preferably 0.2 parts by weight or more, even more preferably 0.5 parts by weight or more, and even more preferably 0.8 parts by weight or more, based on 100 parts by weight of the toner matrix particles, from the viewpoint of suppressing the generation of non-printed spots in characters of a toner and maintaining an appropriate optical density. In addition, the external additive A and the external additive B are contained in a total amount of preferably 3 parts by weight or less, more preferably 1.5 parts by weight or less, even more preferably 1.2 parts by weight or less, and even more preferably 1.0 part by weight or less, based on 100 parts by weight of the toner matrix particles, from the viewpoint of suppressing the generation of non-printed spots in characters of a toner. From these viewpoints taken together, the external additive A and the external additive B are contained in a total amount of preferably from 0.05 to 3 parts by weight, more preferably from 0.2 to 1.5 parts by weight, even more preferably from 0.5 to 1.2 parts by weight, and even more preferably from 0.8 to 1.0 part by weight, based on 100 parts by weight of the toner matrix particles.

<Ratio of External Additive A/External Additive B>

The external additive A and the external additive B are in a weight ratio, i.e. external additive A/external additive B, of preferably from 75/25 to 25/75, more preferably from 70/30 to 30/70, even more preferably from 60/40 to 40/60, and even more preferably from 50/50 to 40/60, from the viewpoint of suppressing the generation of non-printed spots in characters of a toner.

In addition, the external additive A and the external additive B are in a weight ratio of preferably from 75/25 to 60/40, from the viewpoint of controlling triboelectric charges of a toner to an appropriate level, and controlling an optical density to an appropriate level.

<Other External Additives>

The toner of the present invention may properly contain an external additive other than the external additive A and the external additive B within an amount that would not impair the effects of the present invention.

<Toner Matrix Particles>

The toner of the present invention contains toner material particles that contain a resin binder and a colorant.

[Resin Binder]

It is preferable that a resin binder used in the present invention contains a polyester, from the viewpoint of having excellent low-temperature fixing ability, storage stability, and durability of the toner. It is preferable to use as the resin binder only a polyester, but the resin binder may contain a resin other than the polyester in an amount within the range that would not impair the effects of low-temperature fixing ability. The other resin binder includes vinyl resins, epoxy resins, polycarbonates, polyurethanes, and the like.

The polyester used in the present invention is obtained by polycondensing an alcohol component containing a dihydric or higher polyhydric alcohol and a carboxylic acid component containing a dicarboxylic or higher polycarboxylic acid compound.

The dihydric alcohol includes, for example, diols having 2 to 20 carbon atoms, and preferably 2 to 15 carbon atoms; an alkylene oxide adduct of bisphenol A represented by the formula (I):

(I)

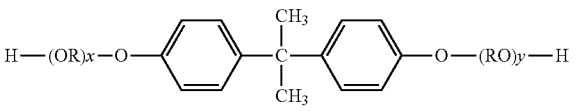

wherein each of RO and OR is an oxyalkylene group, wherein R is an ethylene group and/or a propylene group; x and y are number of moles of alkylene oxides added, each being a positive number, wherein an average of the sum of x and y is preferably from 1 to 16, more preferably from 1 to 8, and even more preferably from 1.5 to 4; and the like.

Specifically, the dihydric alcohol having 2 to 20 carbon atoms includes ethylene glycol, propylene glycol, 1,4-butanediol, 1,6-hexanediol, bisphenol A, hydrogenated bisphenol A, and the like.

The alcohol component is preferably an alkylene oxide adduct of bisphenol A represented by the formula (I) from the viewpoint of improving triboelectric stability, suppressing the generation of non-printed spots in characters, and maintaining an appropriate optical density of a toner. The alkylene oxide adduct of bisphenol A represented by the formula (1) is contained in an amount of preferably 50% by mol or more, more preferably 70% by mol or more, even more preferably 90% by mol or more, and even more preferably substantially 100% by mol, of the alcohol component.

The trihydric or higher polyhydric alcohol includes, for example, trihydric or polyhydric alcohols having 3 to 20 carbon atoms, and preferably 3 to 10 carbon atoms. Specifically, the trihydric or polyhydric alcohol includes sorbitol, 1,4-sorbitan, pentaerythritol, glycerol, trimethylolpropane, and the like.

The dicarboxylic acid compound includes, for example, dicarboxylic acids having 3 to 30 carbon atoms, preferably 3 to 20 carbon atoms, and more preferably 3 to 10 carbon atoms; and derivatives such as acid anhydrides and alkyl(1 to 8 carbon atoms) esters of those acids; and the like. Specifically, the dicarboxylic acid compound includes aromatic dicarboxylic acids such as phthalic acid, isophthalic acid, and terephthalic acid; and aliphatic dicarboxylic acids such as fumaric acid, maleic acid, succinic acid, glutaric acid, adipic acid, sebacic acid, substituted succinic acids of which substituent is an alkyl group having 1 to 20 carbon atoms or an alkenyl group having 2 to 20 carbon atoms.

The tricarboxylic or higher polycarboxylic acid compound includes, for example, tricarboxylic or higher dicarboxylic acids having preferably 4 to 30 carbon atoms, more preferably 4 to 20 carbon atoms, and even more preferably 4 to 10 carbon atoms; and derivatives such as acid anhydrides and alkyl(1 to 8 carbon atoms) esters of those acids; and the like. Specifically, the tricarboxylic or higher polycarboxylic acid compound includes 1,2,4-benzenetricarboxylic acid (trimellitic acid), 1,2,4,5-benzenetetracarboxylic acid (pyromellitic acid), and the like.

Here, the alcohol component may properly contain a monohydric alcohol, and the carboxylic acid component may properly contain a monocarboxylic acid compound, from the viewpoint of adjusting a softening point of the polyester.

The carboxylic acid component and the alcohol component in the polyester are in an equivalent ratio, i.e. COOH group/OH group, of preferably from 0.70 to 1.10, and more preferably from 0.75 to 1.00, from the viewpoint of reducing an acid value of the polyester.

The polycondensation reaction of the alcohol component and the carboxylic acid component can be carried out by polycondensing the alcohol component and the carboxylic acid component in an inert gas atmosphere at a temperature of from 180° to 250° C. or so, optionally in the presence of an esterification catalyst, an esterification promoter, a polymerization inhibitor or the like. The esterification catalyst includes tin compounds such as dibutyltin oxide and tin(II) 2-ethylhexanoate; titanium compounds such as titanium diisopropylate bistriethanolaminate; and the like. The esterification promoter includes gallic acid, and the like. The esterification catalyst is used in an amount of preferably from 0.01 to 1.5 parts by weight, and more preferably from 0.1 to 1.0 part by weight, based on 100 parts by weight of a total amount of the alcohol component and the carboxylic acid component. The esterification promoter is used in an amount of preferably from 0.001 to 0.5 parts by weight, and more preferably from 0.01 to 0.1 parts by weight, based on 100 parts by weight of a total amount of the alcohol component and the carboxylic acid component.

It is preferable that the resin binder used in the present invention contains:

a polyester obtained by polycondensing an alcohol component preferably containing 90% by mol or more, and more preferably substantially 100% by mol, of an alkylene oxide adduct of bisphenol A represented by the formula (I), and a carboxylic acid component containing preferably 90% by mol or more, more preferably substantially 100% by mol, of one or more carboxylic acids selected from isophthalic acid and terephthalic acid (polyester I); and a polyester obtained by polycondensing an alcohol component containing preferably 90% by mol or more, and more preferably substantially 100% by mol, of an alkylene oxide adduct of bisphenol A represented by the formula (I), and a carboxylic acid component containing preferably 90% by mol or more, and more preferably substantially 100% by mol, of fumaric acid (polyester II), from the viewpoint of suppressing the generation of non-printed spots in characters.

It is preferable that the polyester I is a polyester obtained by polycondensing an alcohol component containing preferably 90% by mol or more, and more preferably substantially 100% by mol, of an alkylene oxide adduct of bisphenol A represented by the formula (I), and a carboxylic acid component containing preferably 90% by mol or more, more preferably substantially 100% by mol, of isophthalic acid, from the viewpoint of suppressing the generation of non-printed spots in characters.

The polyester I and the polyester II are contained in a total amount of preferably 80% by weight or more, more preferably 90% by weight or more, and even more preferably substantially 100% by weight, of the resin binder.

The polyester I is contained in an amount of preferably 20% by weight or more, more preferably 50% by weight or more, and even more preferably 70% by weight or more, of a total amount of the polyester I and the polyester II, from the viewpoint of suppressing the generation of non-printed spots in characters.

The polyester II is contained in an amount of preferably 80% by weight or less, more preferably 50% by weight or less, and even more preferably 30% by weight or less, of a total amount of the polyester I and the polyester II, from the viewpoint of suppressing the generation of non-printed spots in characters.

The polyester has a softening point of preferably 90° C. or higher, more preferably 95° C. or higher, and even more preferably 100° C. or higher, from the viewpoint of preventing embedment of an external additive into a toner, suppressing the generation of non-printed spots in characters, and maintaining an appropriate optical density, and from the viewpoint of improving high-temperature offset resistance of the toner. In addition, the polyester has a softening point of preferably 120° C. or lower, more preferably 115° C. or lower, and even more preferably 110° C. or lower, from the viewpoint of improving low-temperature fixing ability of the toner. In other words, from these viewpoints taken together, the polyester has a softening point of preferably from 90° to 120° C., more preferably from 95° to 115° C., and even more preferably from 100° to 110° C. In a case where two or more kinds of polyesters are used, it is preferable that a softening point as an overall resin binder also falls within the range mentioned above. The softening point of the overall resin can be obtained by a weighted average, in other words, the sum of the products of each of softening points and the content ratio.

The softening point of the polyester can be controlled by adjusting the kinds and compositional ratios of the alcohol component and the carboxylic acid component, the amount of a catalyst or the like, or selecting reaction conditions such as a reaction temperature, a reaction time, and a reaction pressure.

The polyester has a glass transition temperature preferably 50° C. or higher, and more preferably 55° C. or higher, from the viewpoint of preventing embedment of an external additive into a toner, suppressing the generation of non-printed spots in characters, and maintaining an appropriate optical density, and from the viewpoint of improving storage stability of the toner. In addition, the polyester has a glass transition temperature of preferably 85° C. or lower, and more preferably 80° C. or lower, from the viewpoint of improving low-temperature fixing ability of the toner. In other words, from these viewpoints taken together, the polyester has a glass transition temperature of preferably from 50° to 85° C., and more preferably from 55° to 80° C. In a case where two or more kinds of polyesters are used, it is preferable that a glass transition temperature as an overall resin binder also falls within the range mentioned above. The glass transition temperature of the overall resin can be obtained by a weighted average, in other words, the sum of the products of each of glass transition temperatures and the content ratio.

The glass transition temperature of the polyester can be controlled by the kinds and compositional ratios of the alcohol component and the carboxylic acid component.

In a case where the resin binder is composed of plural polyesters, it is preferable that a weighted average of each of the softening points and the glass transition temperatures of the polyesters falls within the range mentioned above.

The polyester has an acid value of preferably 50 mg KOH/g or less, more preferably 30 mg KOH/g or less, and even more preferably 20 mg KOH/g or less, from the viewpoint of reducing a low-molecular weight component of the resin and preventing embedment of an external additive into a toner, thereby consequently suppressing the generation of non-printed spots in characters and maintaining an appropriate optical density, and from the viewpoint of reducing the amount of —COOH group or —OH group in the resin and improving triboelectric stability of a toner, thereby consequently suppressing the generation of non-printed spots in characters and maintaining an appropriate optical density.

The acid value of the polyester can be controlled by adjusting the kinds and compositional ratios of the alcohol component and the carboxylic acid component, an amount of catalyst or the like, or selecting reaction conditions such as a reaction temperature, a reaction time, and a reaction pressure.

Here, in the present invention, the polyester may be a modified polyester to an extent that the properties thereof are not substantially impaired. The modified polyester refers to, for example, a polyester grafted or blocked with a phenol, a urethane, an epoxy or the like according to a method described in JP-A-Hei-11-133668, JP-A-Hei-10-239903, JP-A-Hei-8-20636, or the like.

[Colorant]

As the colorant, all of the dyes, pigments and the like which are used as colorants for toners can be used, and specifically, carbon blacks, Phthalocyanine Blue, Permanent Brown FG, Brilliant Fast Scarlet, Pigment Green B, Rhodamine-B Base, Solvent Red 49, Solvent Red 146, Solvent Blue 35, quinacridone, carmine 6B, isoindoline, disazo yellow, or the like can be used.

The colorant in the toner matrix particles is contained in an amount of preferably from 1 to 40 parts by weight, and more preferably from 2 to 10 parts by weight, based on 100 parts by weight of the resin binder, from the viewpoint of improving an optical density, and from the viewpoint of economic advantages.

In the toner of the present invention, the toner matrix particles may properly contain a releasing agent or a charge control agent.

[Releasing Agent]

The releasing agent includes aliphatic hydrocarbon waxes such as low-molecular weight polypropylenes, low-molecular weight polyethylenes, low-molecular weight polypropylene-polyethylene copolymers, microcrystalline waxes, paraffinic waxes, and Fischer-Tropsch wax, and oxides thereof; ester waxes such as carnauba wax, montan wax, and sazole wax, deacidified waxes thereof, and fatty acid ester waxes; fatty acid amides, higher alcohols, and the like. Among them, the hydrocarbon waxes and the ester waxes are preferred, from the viewpoint of improving low-temperature fixing ability and storage stability of the toner, and from the viewpoint of suppressing the deposition of the toner to a carrier when used as a two-component developer. From the same viewpoint, carnauba wax is preferred among the ester waxes, and polypropylene wax is preferred among the hydrocarbon waxes.

The releasing agent has a melting point of preferably from 60° to 160° C., and more preferably from 70° to 150° C., from the viewpoint of improving low-temperature fixing ability and storage stability of the toner, and from the viewpoint of suppressing the deposition of the toner to a carrier.

The releasing agent in the toner matrix particles is contained in an amount of preferably from 0.5 to 4 parts by weight, and more preferably from 1 to 3 parts by weight, based on 100 parts by weight of the resin binder, from the viewpoint of improving low-temperature fixing ability and storage stability of the toner, and from the viewpoint of suppressing the deposition of the toner to a carrier when used as a two-component developer.

[Charge Control Agent]

As the charge control agent, any one of negatively chargeable charge control agents and positively chargeable charge control agents can be used.

The negatively chargeable charge control agent includes metal-containing azo dyes, copper phthalocyanine dyes, metal complexes of alkyl derivatives of salicylic acid, nitroimidazole derivatives, boron complexes of benzilic acid, and the like. The metal-containing azo dyes include, for example, "VARIFAST BLACK 3804, "BONTRON S-28," "BONTRON S-31," "BONTRON S-32," "BONTRON S-34," "BONTRON S-36"(hereinabove commercially available from Orient Chemical Co., Ltd.), "T-77," "AIZEN SPILON BLACK TRH" (hereinabove commercially available from Hodogaya Chemical Co., Ltd.), and the like. The metal complexes of alkyl derivatives of salicylic acid include, for example, "BONTRON E-81," "BONTRON E-82," "BONTRON E-84," "BONTRON E-85" (hereinabove commercially available from Orient Chemical Co., Ltd.), and the like. The boron complexes of benzilic acid include, for example, "LR-147" (commercially available from Japan Carlit, Ltd.), and the like. Among them, the metal-containing azo dyes and the metal complexes of alkyl derivatives of salicylic acid are preferred, and the metal complexes of alkyl derivatives of salicylic acid are more preferred, from the viewpoint of improving triboelectric stability, suppressing the generation of non-printed spots in the characters, and maintaining an appropriate optical density of the toner.

The positively chargeable charge control agent includes Nigrosine dyes, triphenylmethane-based dyes, quaternary ammonium salt compounds, polyamine resins, imidazole derivatives, and the like. The Nigrosine dyes include, for example, "Nigrosine Base EX," "Oil Black BS," "Oil Black SO," "BONTRON N-01," "BONTRON N-07," "BONTRON N-09," "BONTRON N-11" (hereinabove commercially available from Orient Chemical Co., Ltd.), and the like. The triphenylmethane-based dyes include, for example, triphenylmethane-based dyes containing a tertiary amine as a side chain. The quaternary ammonium salt compounds include, for example, "BONTRON P-51," "BONTRON P-52" (hereinabove commercially available from Orient Chemical Co., Ltd.), "TP-415" (commercially available from Hodogaya Chemical Co., Ltd.), cetyltrimethylammonium bromide, "COPY CHARGE PX VP435," "COPY CHARGE PSY" (hereinabove commercially available from Clariant GmbH), and the like. The polyamine resins include, for example, "AFP-B" (commercially available from Orient Chemical Co., Ltd.), and the like. The imidazole derivatives include, for example, "PLZ-2001," "PLZ-8001" (hereinabove commercially available from Shikoku Kasei K.K.), and the like. Among them, the quaternary ammonium salt compounds are preferred, from the viewpoint of improving triboelectric stability of the toner, suppressing the generation of non-printed spots in the characters, and maintaining an appropriate optical density.

The charge control agent in the toner matrix particles is contained in an amount of preferably from 0.5 to 5 parts by weight, and more preferably from 1 to 4 parts by weight, based on 100 parts by weight of the resin binder, from the viewpoint of improving triboelectric stability of the toner, suppressing the generation of non-printed spots in the characters, and maintaining an appropriate optical density.

It is preferable that the toner of the present invention contains a negatively chargeable charge control agent and a positively chargeable charge control agent as charge control agents, from the viewpoint of improving triboelectric stability of the toner, suppressing the generation of non-printed spots in the characters, and maintaining an appropriate optical density. It is preferable that a metal-containing azo dye or a metal complex of an alkyl derivative of salicylic acid is contained as the negatively chargeable charge control agent, and that a quaternary ammonium salt compound is contained as the positively chargeable charge control agent. It is more preferable that the metal complex of an alkyl derivative of salicylic acid is contained as the negatively chargeable charge control agent, and that the quaternary ammonium salt compound is contained as the positively chargeable charge control agent.

The positively chargeable charge control agent and the negatively chargeable charge control agent are in a weight ratio, i.e. positively chargeable charge control agent/negatively chargeable charge control agent, of preferably from 1/40 to 1/2, more preferably from 1/30 to 1/3, and even more preferably from 1/20 to 1/5, from the viewpoint of improving triboelectric stability of the toner, suppressing the generation of non-printed spots in the characters, and maintaining an appropriate optical density.

[Other Components]

The toner of the present invention may further properly contain in the toner matrix particles an additive such as a magnetic powder, a fluidity improver, an electric conductivity modifier, an extender, a reinforcing filler such as a fibrous substance, an antioxidant, an anti-aging agent and a cleanability improver.

<Method for Producing Toner>

The toner of the present invention may be a toner obtained by any of conventionally known methods such as a melt-kneading method, an emulsion aggregation method, and a polymerization method, and a pulverized toner produced by the melt-kneading method is preferred, from the viewpoint of productivity and colorant dispersibility. Specifically, the toner matrix particles can be produced by homogeneously mixing raw materials such as a resin binder, a colorant, a charge control agent and a releasing agent with a mixer such as a Henschel mixer, thereafter melt-kneading the mixture, cooling, pulverizing, and classifying the product. On the other hand, a toner produced by the polymerization method or the emulsion aggregation method is preferred from the viewpoint of the production of toners having smaller particle sizes.

<Volume-Median Particle Size of Toner Matrix Particles>

The toner matrix particles have a volume-median particle size ($D_{50}$) of preferably from 3 to 15 μm, more preferably from 4 to 12 μm, and even more preferably from 6 to 9 μm, from the viewpoint of improving image quality of the toner. Here, the term "volume-median particle size ($D_{50}$)" as used herein refers to a particle size of which cumulative volume frequency calculated on a volume percentage is 50% counted from the smaller particle sizes.

<Step of Treating with External Additive>

In the mixing of the toner matrix particles with an external additive, a mixer equipped with a stirring tool such as rotary impellers is preferably used, and a High-Speed mixer such as a Henschel mixer or Super Mixer is preferred, and a Henschel mixer is more preferred.

The external additive A and the external additive B may be previously mixed and added to a High-Speed mixer or a V-type blender, or the external additive A and the external additive B may be separately added.

The peripheral speed of the mixer is preferably from 20 to 45 m/sec, and more preferably from 25 to 40 m/sec, from the viewpoint of preventing an external additive from being released without being deposited to the toner matrix particles and preventing embedment of an external additive to the toner matrix particles.

<Physical Properties of Toner>

[Softening Point]

The toner has a softening point of preferably 120° C. or lower, more preferably 115° C. or lower, and even more preferably 110° C. or lower, from the viewpoint of improving low-temperature fixing ability of the toner. In addition, the toner has a softening point of preferably 90° C. or higher, more preferably 95° C. or higher, and even more preferably 100° C. or higher, from the viewpoint of preventing embedment of the external additive into the toner, suppressing the generation of non-printed spots in the characters, and maintaining an appropriate optical density, and from the viewpoint of improving high-temperature offset resistance of the toner. In other words, from these viewpoints taken together, the toner has a softening point of preferably from 90° to 120° C., more preferably from 95° to 115° C., and even more preferably from 100° to 110° C.

A method of adjusting a softening point includes a method in which a resin having a specified softening point is used. The method of adjusting a softening point of a resin includes, for example, a method of adjusting a molar ratio of a carboxylic acid component to an alcohol component, and a method of modifying reaction conditions for esterification, such as a reaction temperature, an amount of a catalyst, and a dehydration reaction that is carried out for a long period time under reduced pressure. Specifically, a softening point can be elevated by having a ratio of a carboxylic acid component to an alcohol component approximating to 1, or by an elevation of a reaction temperature, an increase in an amount of a catalyst, an extension of a dehydration reaction time, or the like. On the other hand, if the conditions given above are reversed, the softening point is likely to be lowered.

[Glass Transition Temperature]

The toner has a glass transition temperature of preferably 70° C. or lower, and more preferably 65° C. or lower, from the viewpoint of improving low-temperature fixing ability of the toner. In addition, the toner has a glass transition temperature of preferably 45° C. or higher, and more preferably 50° C. or higher, from the viewpoint of preventing embedment of the external additive into the toner, thereby suppressing the generation of non-printed spots in the characters, and maintaining an appropriate optical density, and from the viewpoint of improving storage stability of the toner. In other words, from these viewpoints taken together, the toner has a glass transition temperature of preferably from 45° to 70° C., and more preferably from 50° to 65° C.

<Method of Forming Fixed Images>

The toner of the present invention is capable of improving triboelectric stability, suppressing the generation of non-printed spots in the characters, and maintaining an appropriate optical density of the toner, even when used in a method of forming fixed images using an apparatus for forming fixed images according to a non-contact fusing method, such as oven fusing or flash fusing. Therefore, the toner can be suitably used in an apparatus for forming fixed images according to a non-contact fusing method using a high speed having a linear speed of 800 mm/sec or more, and preferably from 1000 to 3000 mm/sec. Here, the term "linear speed" refers to a processing speed for an apparatus for forming fixed images, which is determined by a paper-feeding speed at a fixing member.

In addition, a method for development of the toner of the present invention is not particularly limited, and the toner can also be suitably used for a method of forming fixed images using an apparatus for forming fixed images according to a hybrid development method, from the viewpoint of being capable of improving triboelectric stability of the toner, suppressing the generation of non-printed spots in the characters, and maintaining an appropriate optical density. The toner can also be suitably used in an apparatus for forming fixed images according to a hybrid development method using a high speed having a linear speed of 800 mm/sec or more, and preferably from 1000 to 3000 mm/sec.

Here, the hybrid development method is described in *Journal of the Imaging Society of Japan,* 49(2), 102-107 (2010), in which a toner is charged with a carrier in a two-component developer, and the charged toner is transferred from the two-component developer transported with a magnetic roller to a developer roller due to a potential difference between the magnetic roller and the developer roller, and the toner is then transferred from the developer roller to a latent image member of the photoconductor, whereby the development is carried out while the developer roller and the photoconductor are kept in a non-contact state.

The toner of the present invention can be directly used as a toner for monocomponent development, or mixed with a carrier to provide a two-component developer. The toner is suitably used in an apparatus for forming fixed images according to a nonmagnetic development method, especially a nonmagnetic two-component development method, from the viewpoint of obtaining stable triboelectric chargeabilty under stirring conditions with a carrier.

Therefore, the toner of the present invention can also be suitably used in a method of forming fixed images using an apparatus for forming fixed images using a high speed, according to a nonmagnetic development method and a hybrid development method.

<Two-Component Developer>

[Carrier]

In the present invention, as the carrier, a carrier having a low saturation magnetization which has a weaker contact with a magnetic brush is preferable, from the viewpoint of the image properties. The carrier has a saturation magnetization of preferably from 40 to 100 $Am^2/kg$, and more preferably from 50 to 90 $Am^2/kg$. The carrier has a saturation magnetization of preferably 100 $Am^2/kg$ or less, from the viewpoint of controlling the hardness of the magnetic brush and retaining the tone reproducibility, and the carrier has a saturation magnetization of preferably 40 $Am^r/kg$ or more, from the viewpoint of preventing the carrier from being adhered and toner dust.

A carrier contains a core material and a coating material.

[Core Material for Carrier]

As a core material for the carrier, any of a known material can be used without any particular limitation. The core material includes, for example, ferromagnetic metals such as iron, cobalt and nickel; alloys and compounds such as magnetite, hematite, ferrite, copper-zinc-magnesium ferrite, manganese ferrite, and magnesium ferrite; glass beads; and the like. Among them, magnetite, ferrite, copper-zinc-magnesium ferrite, and manganese ferrite are preferable, and copper-zinc-magnesium ferrite are more preferable, from the viewpoint of improving triboelectric stability, suppressing the generation of non-printed spots in characters, and maintaining an appropriate optical density of a toner.

[Coating Material for Carrier]

The surface of the carrier may be coated with a resin, from the viewpoint of preventing the formation of toner scumming on the carrier. The resin for coating the surface of the carrier may vary depending upon the raw materials for toners to be used together, and includes, for example, fluororesins such as polytetrafluoroethylenes, monochlorotrifluoroethylene polymers and poly(vinylidene fluorides); silicone resins such as polydimethyl siloxane; polyesters, styrenic resins, acrylic resins, polyamides, polyvinyl butyrals, aminoacrylate resins, and the like. The silicone resin are preferred, from the viewpoint of improving triboelectric stability of a toner, suppressing the generation of non-printed spots in characters, and maintaining an appropriate optical density. These resins can be used alone or in a combination of two or more kinds.

The method of coating a core material with a resin is not particularly limited, and includes, for example, a method of dissolving or suspending a coating material such as a resin in a solvent, and applying the solution or suspension to be deposited on a core material, a method of blending a resin powder and a core material to be deposited on a core material, and the like.

[Mixing Ratio of Toner and Carrier]

In a two-component developer obtained by mixing a toner with a carrier, the toner is contained in an amount of preferably 2% by weight or more, more preferably 3% by weight or more, and even more preferably 4% by weight or more, of the two-component developer, from the viewpoint of preventing embedment of an external additive into a toner, suppressing the generation of non-printed spots in characters, and maintaining an appropriate optical density. In addition, the toner is contained in an amount of preferably 10% by weight or less, more preferably 9% by weight or less, and even more preferably 8% by weight or less, of the two-component developer, from the viewpoint of improving triboelectric stability, suppressing the generation of non-printed spots in characters, and maintaining an appropriate optical density of a toner. From these viewpoints taken together, the toner is contained in an amount of preferably from 2 to 10% by weight, more preferably from 3 to 9% by weight, and even more preferably from 4 to 8% by weight, of the two-component developer.

EXAMPLES

The following examples further describe and demonstrate embodiments of the present invention. The examples are given solely for the purposes of illustration and are not to be construed as limitations of the present invention.

[Softening Points of Resins and Toners]

The softening point refers to a temperature at which half of the sample flows out, when plotting a downward movement of a plunger of a flow tester (commercially available from Shimadzu Corporation, CAPILLARY RHEOMETER "CFT-500D"), against temperature, in which a 1 g sample is extruded through a nozzle having a die pore size of 1 mm and a length of 1 mm with applying a load of 1.96 MPa thereto with the plunger, while heating the sample so as to raise the temperature at a rate of 6° C./min.

[Glass Transition Temperatures of Resins and Toners]

Measurements were taken using a differential scanning calorimeter ("Q-100," commercially available from TA Instruments, Japan), by heating a 0.01 to 0.02 g sample weighed out in an aluminum pan to 200° C., cooling the sample from that temperature to 0° C. at a cooling rate of 10° C./min, and raising the temperature of the sample at a rate of 10° C./min. A temperature of an intersection of the extension of the baseline of equal to or lower than the temperature of maximum endothermic peak and the tangential line showing the maximum inclination between the kick-off of the peak and the top of the peak is defined as a glass transition temperature.

[Acid Values of Resins]

The acid value is determined by a method according to JIS K0070 except that only the determination solvent is changed from a mixed solvent of ethanol and ether as defined in JIS K0070 to a mixed solvent of acetone and toluene (volume ratio of acetone:toluene=1:1).

[Melting Point of Releasing Agent]

A temperature of maximum endothermic peak of the heat of fusion obtained by raising the temperature of a sample to 200° C., cooling the sample from this temperature to 0° C. at a cooling rate of 10° C./min, and thereafter raising the temperature of the sample at a heating rate of 10° C./min, using a differential scanning calorimeter ("DSC 210," commercially available from Seiko Instruments, Inc.) is referred to as a melting point.

[Average Primary Particle Size of External Additive]

Particle sizes were determined for 500 particles from a photograph taken with a scanning electron microscope (SEM), an average of length and breadth of the particles of which is taken, and the average is referred to as an average primary particle size.

[Carbon Content of External Additive]

The amount 0.05 g of an external additive was placed in a combustion boat (crucible contained in a combustion furnace) having sizes of 12 mm×9 mm×60 mm, and 0.5 g of a tin powder was covered thereon as a combustion aid. Using a carbon analyzer for solid samples (manufactured product of HORIBA, Ltd.: Model EMIA-110), and setting the measurement to AUTO mode, the combustion boat containing the external additive and the combustion aid was combusted for 120 seconds in an oxygen atmosphere under conditions of a furnace temperature of 1200° C. and a furnace pressure of 0.08 MPa to determine a carbon content.

[Volume-Median Particle Size ($D_{50}$) of Toner]

Measuring Apparatus: Coulter Multisizer II (commercially available from Beckman Coulter, Inc.)

Aperture Diameter: 100 μm

Analyzing Software: Coulter Multisizer AccuComp Ver. 1.19 (commercially available from Beckman Coulter, Inc.)

Electrolytic solution: "Isotone II" (commercially available from Beckman Coulter, Inc.)

Dispersion: "EMULGEN 109P" (commercially available from Kao Corporation, polyoxyethylene lauryl ether, HLB: 13.6) is dissolved in the above electrolytic solution so as to have a concentration of 5% by weight to provide a dispersion. Dispersion Conditions: Ten milligrams of a measurement sample is added to 5 ml of the above dispersion, and the mixture is dispersed for 1 minute with an ultrasonic disperser, and 25 ml of the above electrolytic solution is added to the dispersion, and further dispersed with an ultrasonic disperser for 1 minute, to prepare a sample dispersion.

Measurement Conditions: The above sample dispersion is added to 100 ml of the above electrolytic solution to adjust to a concentration at which particle sizes of 30,000 particles can be measured in 20 seconds, and thereafter the 30,000 particles are measured, and a volume-median particle size ($D_{50}$) is obtained from the particle size distribution.

[Saturation Magnetization of Carrier]

(1) A carrier is filled in a plastic case with a lid with tapping, the case having an outer diameter of 7 mm (inner diameter of 6 mm) and a height of 5 mm. The mass of the carrier is obtained from the difference of the weight of the plastic case and the weight of the plastic case filled with the carrier.

(2) The plastic case filled with the carrier is set in a sample holder of a device for measuring magnetic property "BHV-50H" (V. S. MAGNETOMETER) commercially available from Riken Denshi Co., Ltd. The saturation magnetization is determined by applying a magnetic field of 79.6 kA/m, while vibrating the plastic case using the vibration function. The value obtained is calculated as the saturation magnetization per unit mass, taking into consideration the mass of the filled carrier.

Production Examples of External Additives

Production Example 1 of External Additive [External Additive B1]

One-hundred parts by weight of a silica raw powder having an average primary particle size of 40 nm was stirred at 20° C. in a mixing vessel, and a solution prepared by diluting 10 parts by weight of dimethyl silicone oil (commercially available from Shin-Etsu Chemical Co., Ltd., KF-96-100cs) in 20 parts by weight of a solvent n-hexane was sprayed in a nitrogen atmosphere. While continuing to stir, the temperature inside the vessel was raised to 105° C., and kept at that temperature for 2 hours, and then cooled to 20° C., to provide an external additive B1 as shown in Table 2.

Production Example 2 of External Additive [External Additive B2]

The same procedures as in Production Example 1 of External Additive were carried out except that the amount of dimethyl silicone oil was changed to 8 parts by weight, to provide an external additive B2 as shown in Table 2.

Production Example 3 of External Additive [External Additive B3]

The same procedures as in Production Example 1 of External Additive were carried out except that the amount of dimethyl silicone oil was changed to 20 parts by weight, to provide an external additive B3 as shown in Table 2.

Production Example 4 of External Additive [External Additive b1]

The same procedures as in Production Example 1 of External Additive were carried out except that the amount of dimethyl silicone oil was changed to 7 parts by weight, to provide an external additive b1 as shown in Table 2.

Production Example 5 of External Additive [External Additive b2]

The same procedures as in Production Example 1 of External Additive were carried out except that the amount of dimethyl silicone oil was changed to 23 parts by weight, to provide an external additive b2 as shown in Table 2.

Physical properties of the external additives used in Examples and Comparative Examples are shown in Tables 1 and 2.

TABLE 1

| | $SiO_2/TiO_2$ Ratio | $TiO_2$ Content*6 (% by weight) | Form | Average Primary Particle Size (nm) | Surface Treatment Agent | Carbon Content (% by weight) |
|---|---|---|---|---|---|---|
| External Additive A1*1 | 15/85 | 85 | Composite Oxide (Core-Shell Form) | 18 | Hexamethyldisilazane | 1.1 |
| External Additive A2*2 | 5/95 | 95 | Composite Oxide (Core-Shell Form) | 22 | Hexamethyldisilazane | 1.0 |
| External Additive a1*3 | 98/2 | 2 | Composite Oxide (Non-Core-Shell Form) | 79 | Hexamethyldisilazane | 0.4 |
| External Additive a2*4 | 15/85 | — | Mixture of $SiO_2$ particles and $TiO_2$ Particles | 20/15*7 | Hexamethyldisilazane/ Isobutylmethoxysilane*8 | 4.9 |
| External Additive a3*5 | 0/100 | 100 | — | 15 | Isobutylmethoxysilane | 5.5 |

*1Composite Oxide Particles STX801 (commercially available from Nippon Aerosil Co., Ltd.)
*2Composite Oxide Particles STX501 (commercially available from Nippon Aerosil Co., Ltd.)
*3Composite Oxide Particles TSX-77 (commercially available from Shin-Etsu Chemical Co., Ltd.)
*4Mixture of silica NX90G (commercially available from Nippon Aerosil Co., Ltd.) and titania JMT-150IB (commercially available from Tayca Corporation)
*5Titania JMT-150IB (commercially available from Tayca Corporation)
*6$TiO_2$ Content of Composite Oxide Particles Before Hydrophobic Treatment
*7Average Primary Particle Size of $SiO_2$ Particles/Average Primary Particle Size of $TiO_2$ Particles
*8Hydrophobic Treatment Agent for $SiO_2$ Particles/Hydrophobic Treatment Agent for $TiO_2$ Particles

TABLE 2

| | Average Primary Particle Size (nm) | Surface Treatment Agent | Carbon Content (% by weight) |
|---|---|---|---|
| External Additive B1 | 40 | Dimethylsilicone Oil | 3.2 |
| External Additive B2 | 40 | Dimethylsilicone Oil | 2.8 |
| External Additive B3 | 40 | Dimethylsilicone Oil | 5.6 |
| External Additive b1 | 40 | Dimethylsilicone Oil | 2.5 |

TABLE 2-continued

| | Average Primary Particle Size (nm) | Surface Treatment Agent | Carbon Content (% by weight) |
|---|---|---|---|
| External Additive b2 | 40 | Dimethylsilicone Oil | 6.1 |
| External Additive b3*1 | 20 | Hexamethyldisilazane | 1.2 |
| External Additive b4*2 | 40 | Hexamethyldisilazane | 0.6 |
| External Additive b5*3 | 16 | Dimethyldichlorosilane | 0.8 |

*1Silica NX90G (commercially available from Nippon Aerosil Co., Ltd.)
*2Silica NAX50 (commercially available from Nippon Aerosil Co., Ltd.)
*3Silica R972 (commercially available from Nippon Aerosil Co., Ltd.)

Production Examples of Resins

Production Example 1 of Resin [Resin A (Polyester I)]

A 5-liter four-neck flask equipped with a nitrogen inlet tube, a dehydration tube, a stirrer, and a thermocouple was charged with raw material monomers as listed in Table 3 and 19.5 g of an esterification catalyst (dibutyltin oxide), and the temperature was raised to 230° C. The contents were reacted until a reaction rate of 90% was reached, and further reacted at 8.3 kPa for 1 hour, to provide a resin A. Here, the reaction rate in the present invention refers to a value calculated by [amount of water generated (mol)/theoretical amount of water generated (mol)]×100.

Production Example 2 of Resin [Resin B (Polyester II)]

A 5-liter four-neck flask equipped with a nitrogen inlet tube, a dehydration tube, a stirrer, and a thermocouple was charged with raw material monomers as listed in Table 3, 19.5 g of an esterification catalyst (dibutyltin oxide), and 2 g of a polymerization inhibitor (hydroquinone), and the temperature was raised to 230° C. The contents were reacted until a reaction rate of 90% was reached, and further reacted at 8.3 kPa for 1 hour, to provide a resin B.

Production Example 3 of Resin [Resin C (Polyester I)]

A 5-liter four-neck flask equipped with a nitrogen inlet tube, a dehydration tube, a stirrer, and a thermocouple was charged with raw material monomers as listed in Table 3 and 19.5 g of an esterification catalyst (dibutyltin oxide), and the temperature was raised to 230° C. The contents were reacted until a reaction rate of 90% was reached, and further reacted at 8.3 kPa for 1 hour, to provide a resin C.

TABLE 3

| | Resin A | Resin B | Resin C |
|---|---|---|---|
| BPA-PO[1)] | 980 g(35) | 2688 g(100) | 980 g(35) |
| BPA-EO[2)] | 1690 g(65) | | 1690 g(65) |
| Fumaric Acid | | 929 g(105) | |
| Isophthalic Acid | 1223 g(92) | | |
| Terephthalic Acid | | | 1223 g(92) |
| Softening Point (° C.) | 109.1 | 100.1 | 112.1 |
| Glass Transition Temperature (° C.) | 63.2 | 60.5 | 67.7 |
| Acid Value (mgKOH/g) | 3.5 | 19.2 | 3.2 |

[1)]BPA-PO: Polyoxypropylene(2.2)-2,2-bis(4-hydroxyphenyl)propane

[2)]BPA-EO: Polyoxyethylene(2.2)-2,2-bis(4-hydroxyphenyl)propane

Values inside the parentheses ( ) show a molar ratio, supposing that a total molar ratio of the alcohol component in a condensed resin is 100.

Production Examples of Toners

Examples 1, 3-6, 8, and 9 and Comparative Examples 1-12

Seventy parts by weight of Resin A and 30 parts by weight of Resin B as resin binders, 6 parts by weight of a colorant "Carbon Black NIPEX60" (commercially available from Evonik Degussa Japan Co., Ltd.), 2 parts by weight of a negatively chargeable charge control agent "azo-iron-based complex BONTRON S-28" (commercially available from Orient Chemical Co., Ltd.), 0.1 parts by weight of a positively chargeable charge control agent "quaternary ammonium salt COPY CHARGE PSY" (commercially available from Clariant GmbH), and 2 parts by weight of a releasing agent "Carnauba Wax No. 1" (commercially available from S. Kato & CO., melting point: 81° C.) were mixed with a Henschel mixer for 210 seconds, and the mixture was then melt-kneaded under the following conditions.

A continuous twin open-roller type kneader "Kneadex" (commercially available from MITSUI MINING COMPANY, LIMITED, outer diameter of roller: 14 cm, effective length of roller: 80 cm) was used. The operating conditions of the continuous twin open-roller type kneader are a peripheral speed of a high-rotation roller (front roller) of 75 r/min (32.97 m/min), a peripheral speed of a low-rotation roller (back roller) of 50 r/min (21.98 m/min), and a gap between the rollers of 0.1 mm. The temperatures of the heating medium and the cooling medium inside the rollers were as follows. The high-rotation roller had a temperature at the raw material supplying side of 135° C., and a temperature at the kneaded product discharging side of 90° C., and the low-rotation roller has a temperature at the raw material supplying side of 35° C., and a temperature at the kneaded product discharging side of 35° C. In addition, the feeding rate of the raw material mixture was 10 kg/hour, and the average residence time was about 6 minutes.

The kneaded product obtained above was cooled to 20° C. or lower while pressing with a cooling roller, and the cooled melt-kneaded product was roughly pulverized to a size of 3 mm with Rotoplex (commercially available from TOA KIKAI SEISAKUSHO), and then pulverized with a fluidized bed-type jet mill "AFG-400" (commercially available from HOSOKAWA ALPINE A.G.), the pulverized product was classified with a rotor-type classifier "TTSP" (commercially available from HOSOKAWA ALPINE A.G.), to provide toner matrix particles having a volume-median particle size ($D_{50}$) of 8.5 μm.

To 100 parts by weight of the toner matrix particles obtained were added an external additive A and an external additive B in given amounts shown in Table 4 while mixing with a 75-L Henschel mixer (commercially available from NIPPON COKE & ENGINEERING CO., LTD.) at 1500 r/min (peripheral speed: 38 m/sec) for 3 minutes, to provide a toner. Here, the upper blades on the Henschel mixer used was ST form, and the lower blades were A0 form.

Example 2

The same procedures as in Example 1 except that Resin A was replaced with Resin C, to provide a toner of Example 2. Here, the toner matrix particles had a volume-median particle size ($D_{50}$) of 8.5 μm.

Example 7

The same procedures as in Example 1 except that the colorant was changed to 5 parts by weight of "PR122 Super Magenta R" (commercially available from DIC Corporation), the negatively chargeable charge control agent was changed to 4 parts by weight of "an aluminum-salicylic acid complex BONTRON E-84" (commercially available from Orient Chemical Co., Ltd.), and the positively chargeable charge control agent was changed to 0.3 parts by weight of "quaternary ammonium salt COPY CHARGE PSY" (commercially available from Clariant GmbH), to provide a toner of Example 7. Here, the toner matrix particles had a volume-median particle size ($D_{50}$) of 8.5 μm.

Example 10

The same procedures as in Example 1 except that the amount of Resin A used was changed to 50 parts by weight, and the amount of Resin B used was changed to 50 parts by weight, to provide a toner of Example 10. Here, the toner matrix particles had a volume-median particle size ($D_{50}$) of 8.5 μm.

Example 11

The same procedures as in Example 1 except that the amount of Resin A used was changed to 20 parts by weight, and the amount of Resin B used was changed to 80 parts by weight, to provide a toner of Example 11. Here, the toner matrix particles had a volume-median particle size ($D_{50}$) of 8.5 μm.

Example 12

The same procedures as in Example 2 except that the amount of Resin C used was changed to 20 parts by weight, and the amount of Resin B used was changed to 80 parts by weight, to provide a toner of Example 12. Here, the toner matrix particles had a volume-median particle size ($D_{50}$) of 8.5 μm.

TABLE 4

| | External Additive A (Parts by Weight) | External Additive B (Parts by Weight) | External Additive A/ External Additive B (Weight Ratio) | Softening Point of Toner (° C.) | Glass Transition Temp. of Toner (° C.) |
|---|---|---|---|---|---|
| Ex. 1 | External Additive A1(0.4) | External Additive B1(0.5) | 44/56 | 105.4 | 55.6 |
| Ex. 2 | External Additive A1(0.4) | External Additive B1(0.5) | 44/56 | 106.2 | 58.1 |
| Ex. 3 | External Additive A1(0.6) | External Additive B1(0.5) | 55/45 | 105.4 | 55.6 |
| Ex. 4 | External Additive A1(0.8) | External Additive B1(0.5) | 62/38 | 105.4 | 55.6 |
| Ex. 5 | External Additive A1(0.4) | External Additive B1(1.0) | 29/71 | 105.4 | 55.6 |
| Ex. 6 | External Additive A2(0.4) | External Additive B1(0.5) | 44/56 | 104.7 | 56.0 |
| Ex. 7 | External Additive A1(0.4) | External Additive B1(0.5) | 44/56 | 104.9 | 55.7 |
| Ex. 8 | External Additive A1(0.4) | External Additive B2(0.5) | 44/56 | 105.4 | 55.6 |
| Ex. 9 | External Additive A1(0.4) | External Additive B3(0.5) | 44/56 | 105.6 | 55.9 |
| Ex. 10 | External Additive A1(0.4) | External Additive B1(0.5) | 44/56 | 104.1 | 55.3 |
| Ex. 11 | External Additive A1(0.4) | External Additive B1(0.5) | 44/56 | 102.3 | 54.1 |
| Ex. 12 | External Additive A1(0.4) | External Additive B1(0.5) | 44/56 | 103.2 | 54.5 |
| Comp. Ex. 1 | External Additive A1(0.4) | — | 100/0 | 105.3 | 55.4 |
| Comp. Ex. 2 | External Additive A1(0.9) | — | 100/0 | 105.9 | 55.6 |
| Comp. Ex. 3 | — | External Additive B1(0.5) | 0/100 | 104.9 | 55.7 |
| Comp. Ex. 4 | — | External Additive B1(0.9) | 0/100 | 105.3 | 54.9 |
| Comp. Ex. 5 | External Additive a1(0.4) | External Additive B1(0.5) | 44/56 | 105.1 | 55.9 |
| Comp. Ex. 6 | External Additive a2(0.4) | External Additive B1(0.5) | 44/56 | 104.9 | 56.0 |
| Comp. Ex. 7 | External Additive a3(0.4) | External Additive B1(0.5) | 44/56 | 105.7 | 55.6 |
| Comp. Ex. 8 | External Additive A1(0.4) | External Additive b1(0.5) | 44/56 | 105.1 | 55.7 |
| Comp. Ex. 9 | External Additive A1(0.4) | External Additive b2(0.5) | 44/56 | 104.8 | 55.8 |
| Comp. Ex. 10 | External Additive A1(0.4) | External Additive b3(0.5) | 44/56 | 105.4 | 55.5 |
| Comp. Ex. 11 | External Additive A1(0.4) | External Additive b4(0.5) | 44/56 | 105.3 | 55.2 |
| Comp. Ex. 12 | External Additive A1(0.4) | External Additive b5(0.5) | 44/56 | 105.2 | 56.3 |

Test Example 1 [Characters Containing Non-Printed Spots]

Figure 2:
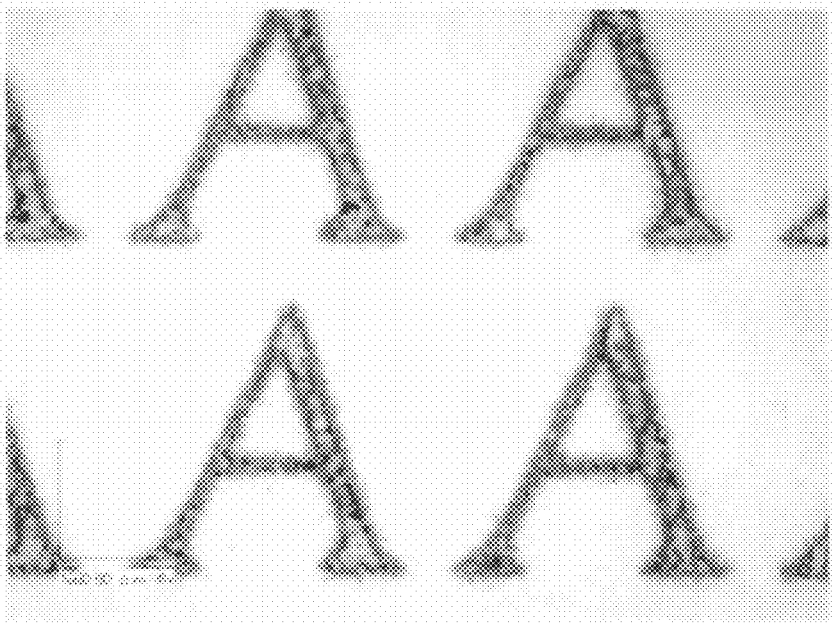
FIG. 2 is an optical photomicrograph (magnification: 50×) showing characters containing non-printed spots in Comparative Example 1.
Figure 3:
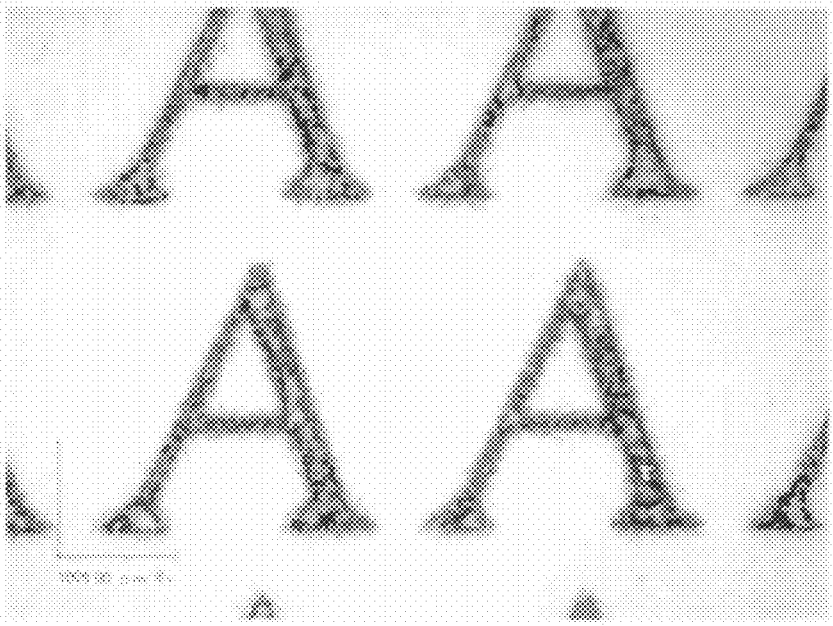
FIG. 3 is an optical photomicrograph (magnification: 50×) showing characters containing non-printed spots in Comparative Example 3.

Six parts by weight of the resulting toner and 94 parts by weight of a carrier "KK01-C35" (core material: copper-zinc-magnesium ferrite, coating material: silicone resin) (commercially available from Oce Printing Systems GmbH, volume-average particle size: 60 μm, saturation magnetization: 68 $Am^2/kg$) were mixed, to provide a two-component developer. The resulting two-component developer was loaded to an apparatus for forming fixed images according to a hybrid development method "Vario stream 9000" (commercially available from Oce Printing Systems GmbH), and printing was continuously conducted at a print coverage of 1% and a linear speed of 1,000 mm/sec for 5 hours, and thereafter 100 characters of the alphabetic character "A" were printed with the font style "Times New Roman" at 9 pt. The fixed images obtained were photographed at a magnification of 50 times with a digital microscope VHX-100 (commercially available from KEYENCE Corporation). Photographed visual images were converted to binary images with the digital microscope VHX-100, and image analysis was conducted for 100 characters. The transfer rate of characters containing non-printed spots was determined in accordance with the following formula, and used as an index for the characters containing non-printed spots. The results are shown in Table 5. Also, the optical photomicrographs showing the characters containing non-printed spots of each of the toners of Example 1, Comparative Example 1, and Comparative Example 3 are shown in FIGS. 1 to 3.

$$\text{Transfer Rate of Characters Containing Non-Printed Spots (\%)} = \frac{\text{Areas of Transfer of Characters Containing Non-Printed Spots (Sum of Areas of Non-Printed Spots in 100 Characters of "A")}}{\text{Area of Characters of "A" (Sum of Areas of Printed Parts and Areas of Non-Printed Spots)}} \times 100$$

Test Example 2 [Optical Density]

Continuously printing was conducted in the same manner as in Test Example 1, and thereafter solid images having sizes 20 cm×20 cm were printed. Optical densities of a fixed image sample were measured at 5 points with a colorimeter "Gretag-Macbeth Spectroeye" (commercially available from X-Rite GmbH), and an average thereof was evaluated as optical density (OD). Here, during the measurement of optical density, the measurement of optical density was carried out in a mode in which a polarized plate is not sandwiched. The results are shown in Table 5.

TABLE 5

| | Transfer Rate of Characters Containing Non-Printed Spots (%) | Optical Density |
|---|---|---|
| Example 1 | 0.37 | 1.7 |
| Example 2 | 0.41 | 1.8 |
| Example 3 | 0.45 | 1.7 |
| Example 4 | 1.61 | 1.8 |
| Example 5 | 1.58 | 1.7 |
| Example 6 | 1.35 | 1.6 |
| Example 7 | 0.49 | 1.7 |
| Example 8 | 3.69 | 1.9 |
| Example 9 | 1.87 | 1.6 |
| Example 10 | 0.41 | 1.8 |
| Example 11 | 0.42 | 1.8 |
| Example 12 | 0.55 | 1.7 |
| Comparative Example 1 | 15.0 | 1.9 |
| Comparative Example 2 | 15.8 | 2.2 |
| Comparative Example 3 | 9.65 | 1.3 |
| Comparative Example 4 | 8.92 | 0.9 |
| Comparative Example 5 | 10.2 | 2.3 |
| Comparative Example 6 | 10.9 | 2.4 |
| Comparative Example 7 | 11.2 | 2.5 |
| Comparative Example 8 | 11.0 | 1.1 |
| Comparative Example 9 | 8.52 | 1.0 |
| Comparative Example 10 | 15.3 | 1.2 |
| Comparative Example 11 | 15.9 | 1.2 |
| Comparative Example 12 | 14.2 | 1.1 |

It can be seen from the above results that the toners of Examples 1 to 12 are very excellently suppressed in non-printed spots contained in the characters, as compared to the toners of Comparative Examples 1 to 12, and that an appropriate optical density of from 1.6 to 2.0 can be obtained.

The toner for electrostatic image development of the present invention is suitably used in, for example, the development or the like of latent image formed in electrophotography, an electrostatic recording method, an electrostatic printing method, or the like, The present invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner for electrostatic image development comprising an external additive comprising composite oxide particles made of titania and silica (external additive A), and hydrophobic silica particles (external additive B), wherein the external additive A comprises a core-shell structure in which a core portion is made of titania and a shell portion is made of silica, wherein the titania is contained in the external additive A in an amount of from 75 to 95% by weight, and wherein the external additive B has a carbon content of from 2.8 to 6.0% by weight.

2. The toner according to claim 1, wherein the external additive A and the external additive B are in a weight ratio, external additive A/external additive B, of from 75/25 to 25/75.

3. The toner according to claim 1, wherein the titania is contained in the external additive A in an amount of from 80 to 95% by weight.

4. The toner according to claim 1, wherein the external additive B has a carbon content of from 3.0 to 5.6% by weight.

5. The toner according to claim 1, wherein the external additive A and the external additive B are in a weight ratio, external additive A/external additive B, of from 60/40 to 40/60.

6. A two-component developer comprising a toner for electrostatic image development as defined in claim 1 and a carrier.

7. The two-component developer according to claim 6, wherein the core material for the carrier is copper-zinc-magnesium ferrite.

8. The two-component developer according to claim 6, wherein the coating material for the carrier is a silicone resin.

9. A method for forming fixed images comprising the step of applying a toner for electrostatic image development as defined in claim 1, or a two-component developer as defined in claim 6 to an apparatus for forming fixed images according to a hybrid development method.

10. The method according to claim 9, wherein the apparatus for forming fixed images has a linear speed of 800 mm/sec or more.

* * * * *